United States Patent [19]

Olson

[11] 4,027,794

[45] June 7, 1977

[54] SHIPPING CONTAINER

[75] Inventor: Gregory J. Olson, Burlington, Wis.

[73] Assignee: Packaging Corporation of America, Evanston, Ill.

[22] Filed: Feb. 17, 1976

[21] Appl. No.: 658,707

[52] U.S. Cl. ..... 206/395; 206/403; 206/446; 206/485; 206/521; 229/14 C; 229/41 R

[51] Int. Cl.[2] ..... B65D 85/672; B65D 5/36

[58] Field of Search ..... 229/14 C, 23 R, 41 R; 206/476, 395, 521, 403, 408, 490, 446, 485; 242/55.53

[56] References Cited

UNITED STATES PATENTS

| | | | |
|---|---|---|---|
| 2,476,996 | 11/1968 | Nebel | 242/71.1 |
| 2,607,476 | 8/1952 | Rockefeller | 206/408 |
| 3,251,533 | 5/1966 | Cohen | 229/23 R |
| 3,332,546 | 7/1967 | De George | 206/395 |
| 3,384,228 | 5/1968 | Cannon | 206/485 |
| 3,412,847 | 11/1968 | Wise et al. | 242/55.53 |
| 3,454,155 | 7/1969 | Voissem et al. | 206/408 |
| 3,530,980 | 9/1970 | Link | 206/408 |
| 3,698,548 | 10/1972 | Stenzel et al. | 242/55.53 |

*Primary Examiner*—Stephen P. Garbe
*Assistant Examiner*—Bruce H. Bernstein
*Attorney, Agent, or Firm*—Neuman, Williams, Anderson & Olson

[57] ABSTRACT

A container is provided to accommodate a cylindrical unit having an axially disposed core. The container includes two complemental sections, each being provided with side walls delimiting a compartment, which coact to contain the unit. Opposed side wall portions on each section include reinforced semicylindrical recesses which completely retain the core ends.

6 Claims, 6 Drawing Figures

SHIPPING CONTAINER

BACKGROUND OF THE INVENTION

This invention relates to shipping containers, and mor particularly to shipping containers of a type employed to accommodate a cylindrical unit having an axially disposed core.

With the advent of wafer-shaped batteries which are commonly employed in modern instant picture cameras, it has become desirable to ship large quantities of batteries in a convenient and secure container, without damaging the individual wafers. Stacking or arranging individual or sheets of wafers within a shipping container may not insure the adequate protection of all wafers. In addition, there is the potential for damage as the wafers are loaded or unloaded from the container.

Substantial amounts of packing material may be required in other shipping containers to properly protect the unit contained. In addition to requiring more material, increased amounts of waste material would be generated following a single use of the container.

One-piece containers may prove awkward and flimsy requiring time-consuming loading and unloading operations, unless the container capacity or utility is restricted.

To accommodate a heavy unit within the shipping container, a container might of necessity require reinforcement along a plurality of surfaces. This not only would require substantially more material or be more costly to manufacture, but could inhibit the collapsed storage configuration of the container.

OBJECTS OF THE INVENTION

Accordingly, it is an object of the present invention to provide a low cost, sturdy, and simplified shipping container to accommodate a cylindrical unit having a core therethrough.

It is another object of this invention to provide a shipping container that is easily loaded and unloaded.

It is a further object of the invention to provide a shipping container that protects the unit contained therein without requiring additional packaging material.

Yet another object of the present invention is to provide a container capable of accommodating a large and/or heavy unit while being of economical, sturdy construction.

A further object of the present invention is to provide a container having all the features above, yet is collapsible for compact storage or shipping, and is reuseable.

Other objects, advantages and features of the invention will become apparent upon reading the following detailed description and appended claims, and upon reference to the accompanying drawings.

SUMMARY OF THE INVENTION

These objects are achieved by a shipping container, according to a preferred embodiment of my invention, which includes at least two complemental sections. Each of the complemental sections are defined by side walls, and end flaps, each foldably connected to a corresponding edge of each side wall and when folded, defining a surface transverse to the side walls. The side walls and surface of each section combine to delimit a compartment which is adapted to contain a predetermined segment of the unit. Extending from opposed peripheral edges of each section's side walls are semicircular recesses which are provided to retain core ends therein.

BRIEF DESCRIPTION OF THE DRAWINGS

For a complete understanding of this invention, reference should now be had to the embodiments illustrated in greater detail in the accompanying drawings and described below by way of an example of the invention.

IN THE DRAWINGS

Figure 1:
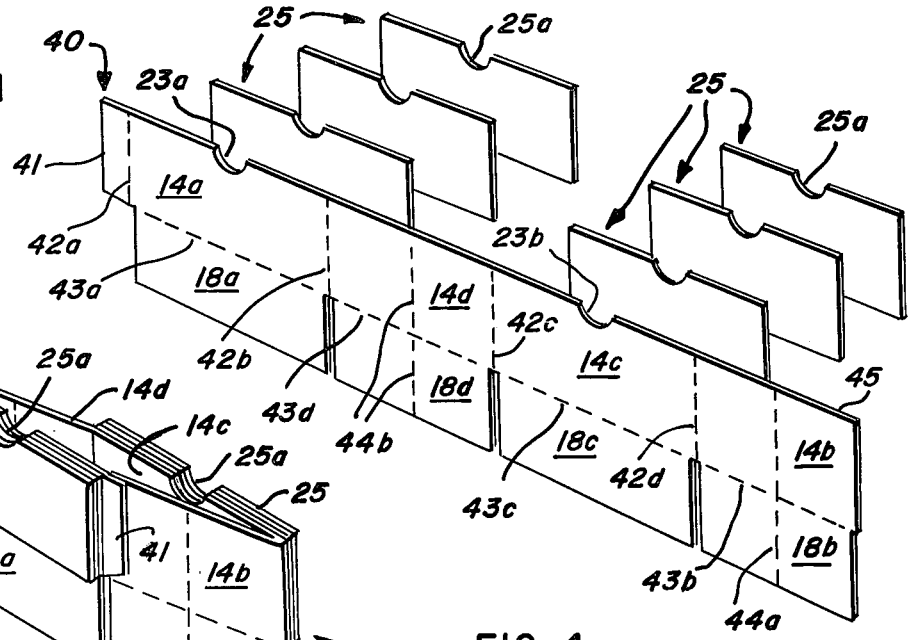
Figure 2:
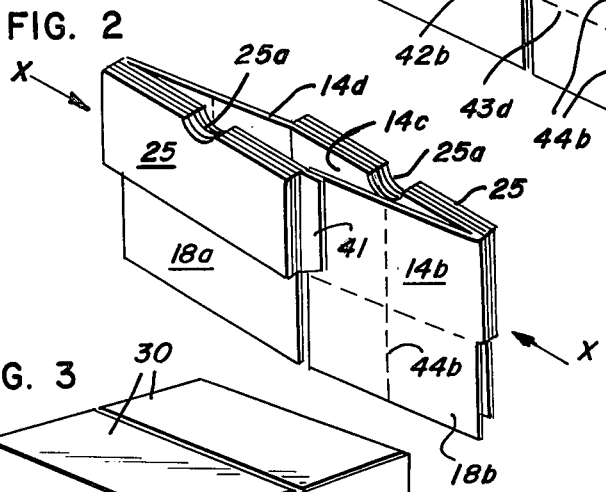
Figure 3:
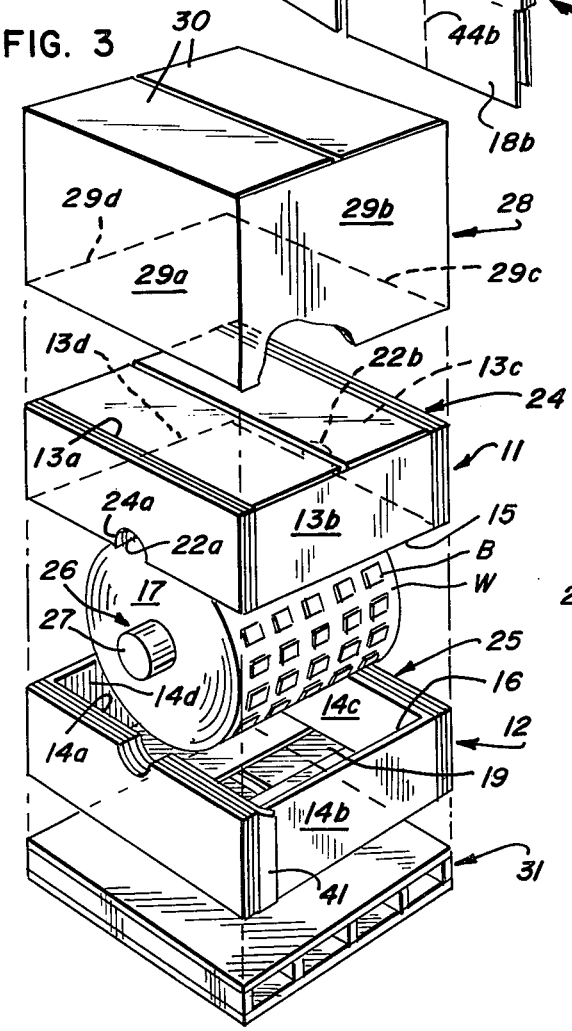
Figure 4:
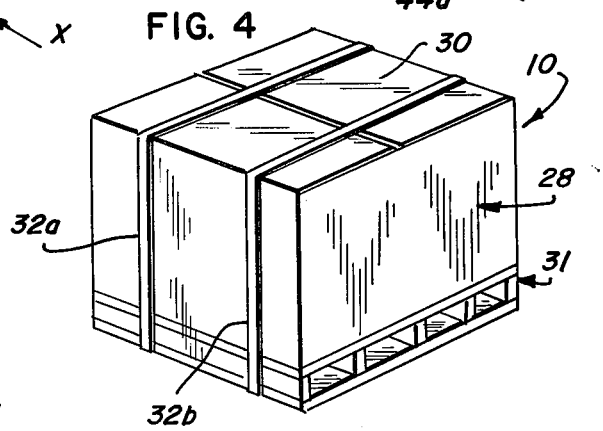
Figure 5:
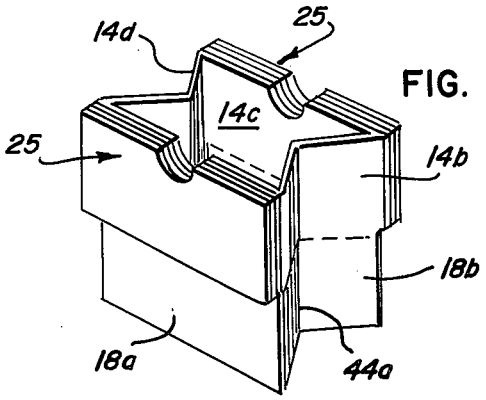
Figure 6:
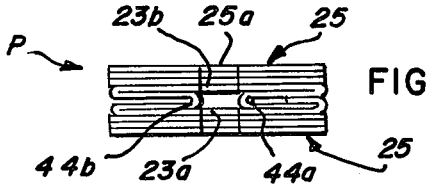

FIG. 1 is a perspective plan view of one form of a blank for one complemental section with side wall reinforcing portions therefor shown in exploded relation;

FIG. 2 is a perspective view of the blank of FIG. 1 in a partially set-up condition and with the side wall reinforcing portions assembly thereon;

FIG. 3 is an exploded perspective view of the preferred embodiment of the improved shipping container in combination with a product accommodated therein;

FIG. 4 is a perspective view of the shipping container of FIG. 3, in a condition ready for shipping or storage;

FIG. 5 is a perspective view of the blank of FIG. 2 in an alternative partially folded condition suitable for storage or shipment; and FIG. 6 is an end view of the blank of FIG. 5 in the alternative fully folded position.

While the invention will be described in connection with a preferred embodiment, it is not intended to be limited thereto, but on the contrary, to cover all alternatives, modifications and equivalents as may be included within the spirit and scope of the invention as defined by the appended claims.

DESCRIPTION

Referring now to the drawings and more particularly to FIG. 3, a preferred embodiment of the improved shipping container 10 is shown which includes complemental housing sections 11 and 12 formed respectively, of side walls 13*a*, 13*b*, 13*c*, 13*d* and side walls 14*a*, 14*b*, 14*c*, and 14*d*. The sections, when in assembled relation, are inverted relative to one another and abut along exposed peripheral edges 15 and 16 to encompass a cylindrical unit 17. End closure flaps 18*a*, 18*b*, 18*c*, 18*d*, as seen in FIG. 1, are foldably connected to an edge of corresponding side walls 14*a*, 14*b*, 14*c*, 14*d* or 13*a*, 13*b* 13*c*, and 13*d* and fold relative to one another to define an end surface 19 of the housing section. The end surface is disposed transverse to the side walls.

Opposed corresponding side walls 13*a*, 13*c* and 14*a*, 14*c* of the respective housing sections 11 and 12 are provided with centrally disposed recessed 22*a*, 22*b* and 23*a*, 23*b* which extend inwardly from exposed abutting edges 15 and 16 thereof, see FIG. 3. A plurality of reinforcing pads 24 and 25 are fixedly attached by adhesive or the like, in face-to-face relation to the outer surfaces of opposed side walls 13*a*, 13*c* and 14*a*, 14*c*, respectively, of housing sections 11 and 12. Each pad is preferably of like configuration and has a recess 24*a* or 25*a* formed in the upper edge thereof which conforms to and is aligned with the corresponding recess formed in the adjacent side wall.

The product (cylindrical unit 17) is provided with an axially disposed core or spindle 26. Coiled about the core 26 may be a web W on which are carried a plurality of very thin batteries B or the like. The ends 27 of the core 26 project axially outwardly and are cradled in the recesses formed in the adjacent side walls and pads affixed thereto. When core 26 is cradled in the recesses and the housing sections 11 and 12 are disposed in abutting relation, the coiled web will be spaced from the interior surfaces of the container 10 and, thus, prevent damage to the batteries B or the like.

As seen in FIGS. 3 and 4, an outer protective cover 28 is normally utilized which is adapted to encompass the abutting housing sections 11 and 12. The cover 28 includes side walls 29*a*, 29*b*, 29*c*, 29*d* and end closure flaps 30 formed on the upper edges of the side walls. The lower end of the cover 28 is open so as to enable the cover to be slipped endwise over the abutting sections. The lower housing section 12 may rest on a wooden pallet 31 which is engaged by the lower end of the cover 28. The cover 28, housing sections 11 and 12 and the pallet 31 are secured in assembled relation by metal straps 32*a* and 32*b*, see FIG. 4.

A blank 40 for one embodiment of a housing section 12 is shown in FIG. 1. Preferably, housing sections 11 and 12 are of like configuration so that they may be interchangeable. Accordingly, only the blank 40 for section 12 will be described in detail. The blank 40 is formed from foldable sheet material, e.g., double-faced corrugated fibreboard, capable of being cut, slotted and scored by conventional high-speed equipment well known in the art. Blank 40 includes foldably connected side walls 14*a*–14*d* arranged in side-by-side relation and a glue flap 41 foldably connected to side wall 14*a*. Fold lines 42*a*, 42*b*, 42*c*, 42*d* interconnect the glue flap and the adjacent side walls. Connected to one corresponding edge of each side wall by foldlines 43*a*, 43*b*, 43*c*, 43*d* are end closure flaps 18*a*, 18*b*, 19*c*, 19*d*, respectively. Two side walls 14*b* 14*d* and their respective closure flaps 18*b*, 18*d* are provided with a centrally disposed foldline 44*a* or 44*b* which is parallel to the foldlines interconnecting the adjacent side walls. The function of foldlines 44*a*, 44*b* will be discussed. As aforementioned, semicircular recesses 23*a* 23*b* are formed on the upper edges 45 of side walls 14*a*, 14*c*. The recesses are centered in the upper edge 45 of each side wall and are shaped so as to readily accommodate the protruding ends 27 of the core 26.

Reinforcing pads 24 and 25 correspond preferably to the shape of side walls to which they are affixed. The pads for a given side wall are affixed in side-by-side relation and then the assembled pads are suitably secured. The number of reinforcing pads utilized for the side walls will depend upon the weight of cylindrical unit 17 to be supported within the container 10 and the type of material used in forming the blank 40 and pads 24 and 25.

When the blank 40 with the pads affixed thereto is set up, the side wall 14*a* and glue flap 41 are folded as a unit about foldline 42*b* so as to overlie side walls 14*d* and part of side wall 14*c*. At the same time, side wall 14*b* is folded about foldline 42*d* so as to overlie side wall 14*c*. The glue flap 41 will overlap the exterior of side wall 14*b* and will be secured thereto, see FIG. 2. When the blank and pads are in a partially set-up condition as seen in FIG. 2, each housing section in such condition may be stored or set to the customer until ready for use. It is important to note that the housing section may readily assume its partially set-up condition because the reinforcing pads are disposed on the exterior surfaces of side walls 14*a* and 14*c*.

When the housing section 10 is to be fully set up for use, pressure is exerted at opposed ends of the partially folded section in the direction indicated by arrows X in FIG. 2 until the side walls 14*a*–14*d* assume a squared or right angle relation. Thereafter, end closure flaps 19 are folded and secured in overlapping relation so as to define surface 19. The lower housing section 12 is then positioned on the pallet 31 with the open end of the section facing upwardly. The cylindrical unit 17 is then positioned within the section 12 so that the core ends 27 will engage the recesses 23*a* and *b* of the side walls 14*a* and 14*c* and the recesses 25*a* of the reinforcing pads. Once the unit 17 is in position within housing section 12, housing section 11 is placed over the unit 17 and lowered into position until the edge thereof defining the lower open side will abut the upper edge of section 12. The recesses 24*a* of the pads 24 and the recesses 22*a* and 22*b* of the side walls 13*a*, 13*c* will be vertically aligned with the corresponding recesses of section 12, thereby capturing the core ends 27 between the sections. The outer protective cover 28 is then slipped endwise over the assembled sections 11 and 12 until the lower edge of the cover rests upon the pallet 31. Metal strappings 32*a* and 32*b* are then drawn tightly around the cover and pallet, see FIG. 4.

After the container 10 has been unloaded, the housing sections may be folded into a compact piece P and stored for reuse, see FIG. 6. As FIG. 5 illustrates, after the end closure flaps 18*a*–18*d* have been unfolded, the reinforced side walls 14*a*, 14*c* are folded towards one another about foldlines 44*b* and 44*a* until side walls 14*b* and 14*d* are folded back upon themselves.

The size and configuration of the housing sections may vary from that shown and will depend upon the configuration and size of the product being accommodated therein. Furthermore, in certain instances the outer protective cover and/or the pallet may be omitted. While it is preferred that the housing sections be the same, it is not essential and, if desired, one section might have a greater depth than the other.

Thus, it will be noted that the improved container has been provided which is of simple, inexpensive construction and yet provides effective reinforcement and protection for the accommodated product. In addition, the container utilizes a minimum number of components which may be readily collapsed for storage or reused if desired.

I claim:

1. A container for accommodating a cylindrical unit provided with axially disposed protrusions at opposite ends thereof, said container comprising a pair of foldable complemental housing sections adapted to assume either a collapsed or setup state, said housing sections having one of said sections disposed in an inverted superposed relation with the other section whereby said sections coact to form a unit-accommodating compartment; each housing section including foldably connected wall panels having corresponding first edges delimiting an open end, the wall panel first edges of said housing sections being in substantially abutting relation when said sections form said unit-accommodating compartment, each housing section having a first pair of wall panels in opposed relation and having interior surfaces positioned adjacent the opposite ends of the unit when the latter is disposed within the unit-accommodating compartment; said first pair of wall panels of each housing section being adapted to be in substantially parallel close proximity to each other when said section is in a collapsed state; and substantially inflexible reinforcing pads affixed to exterior surfaces of said first pair of wall panels of each housing section, said pads and the first edges of the wall panels connected thereto having means on peripheral portions thereof adapted to supportingly engage the unit protrusions when the unit is accommodated within said compartment.

2. The container of claim 1, wherein each housing section is provided with foldable closure flaps along corresponding second edges of the wall panels; said flaps forming a closed end transverse to said wall panels and opposite the open end, said closed end adapted to be spaced from the periphery of the accommodated unit.

3. The container of claim 1, wherein said complemental housing sections are of like configuration and when in compartment forming relation are enclosed within a hollow protective member.

4. The container of claim 1 wherein the first pair of wall panels of each housing section is interconnected by a second pair of opposed wall panels, each wall panel of the second pair having foldable segments disposed in face-to-face relation when said housing section is in a collapsed state.

5. The container of claim 4 wherein the periphery of each pad coincides substantially to the configuration of the side wall exterior surface to which it is affixed.

6. The container of claim 5 wherein corresponding segments of the first edges of the first pair of wall panels and peripheral edges of the reinforcing pads affixed thereto are provided with recesses of like configuration for engaging and supporting the axial protrusions of the accommodated unit.

* * * * *

UNITED STATES PATENT AND TRADEMARK OFFICE

CERTIFICATE OF CORRECTION

PATENT NO. : 4,027,794

DATED : JUNE 7, 1977

INVENTOR(S) : GREGORY J. OLSON

It is certified that error appears in the above-identified patent and that said Letters Patent are hereby corrected as shown below:

Col. 1, line 6 - "mor" should be --more--

Col. 2, line 18 - "assembly" should be --assembled--

Col. 3, line 62 - "set" should be --sent--

Claim 5, line 11 - "side wall" should be --wall panel--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*